US010337462B2

(12) United States Patent
Yang et al.

(10) Patent No.: US 10,337,462 B2
(45) Date of Patent: Jul. 2, 2019

(54) SYSTEM AND METHODS FOR MANAGING FUEL VAPOR CANISTER TEMPERATURE

(71) Applicant: Ford Global Technologies, LLC, Dearborn, MI (US)

(72) Inventors: Dennis Seung-Man Yang, Canton, MI (US); Aed M Dudar, Canton, MI (US); Russell Randall Pearce, Ann Arbor, MI (US); Shahid Ahmed Siddiqui, Northville, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 9 days.

(21) Appl. No.: 14/290,565

(22) Filed: May 29, 2014

(65) Prior Publication Data

US 2015/0345435 A1 Dec. 3, 2015

(51) Int. Cl.
*F02M 25/08* (2006.01)

(52) U.S. Cl.
CPC ..... *F02M 25/0809* (2013.01)

(58) Field of Classification Search
CPC ..... F02M 25/08; F02M 25/0854; F02M 25/0809; F02M 25/0836; F02M 25/0872; F02M 2025/0881
USPC ..... 123/520, 521, 519, 518; 96/108, 112
See application file for complete search history.

(56) References Cited

U.S. PATENT DOCUMENTS 5,861,050 A 1/1999 Pittel et al.
6,230,693 B1 5/2001 Meiller et al.
6,439,277 B1 8/2002 Kyburz
6,689,196 B2 * 2/2004 Amano ..... B01D 53/02 123/519
6,698,403 B2 3/2004 Honda et al.
6,772,741 B1 * 8/2004 Pittel ..... F02M 25/0854 123/519

(Continued)

FOREIGN PATENT DOCUMENTS

WO 2012150397 A2 11/2012

OTHER PUBLICATIONS

Anonymous, "EONV Robustness and Isolation Method for Start/Stop Programs," IPCOM No. 000238494D, Published Aug. 28, 2014, 2 pages.

(Continued)

*Primary Examiner* — Lindsay M Low
*Assistant Examiner* — Omar Morales
(74) *Attorney, Agent, or Firm* — Julia Voutyras; McCoy Russell LLP

(57) ABSTRACT

A system for an engine, comprising: a fuel vapor canister coupled to a fuel tank; a thermal jacket comprising a phase-change material, the thermal jacket spatially sheathing the fuel vapor canister; and an engine coolant passage positioned to transfer thermal energy between engine coolant and the phase-change material. In this way, the phase-change material may buffer the temperature of the fuel vapor canister by absorbing heat generated during hydrocarbon adsorption, and returning the heat to the vapor canister during hydrocarbon desorption. By coupling the phase-change material to engine coolant, the thermal capacity of the thermal jacket can be increased, as heated coolant can thus transfer thermal energy to the phase-change material to replace the thermal energy transferred to the canister during hydrocarbon desorption.

20 Claims, 5 Drawing Sheets

(56) References Cited

U.S. PATENT DOCUMENTS

| | | | | |
|---|---|---|---|---|
| 7,323,041 | B2 * | 1/2008 | Yoshida | F02M 25/0854 123/519 |
| 7,444,996 | B2 | 11/2008 | Potier | |
| 7,488,376 | B2 | 2/2009 | Kim et al. | |
| 7,513,244 | B2 | 4/2009 | Potier | |
| 7,543,574 | B2 | 6/2009 | Yamazaki et al. | |
| 7,600,506 | B2 | 10/2009 | Kopinsky | |
| 7,615,108 | B2 | 11/2009 | Yoshida et al. | |
| 7,757,727 | B2 | 7/2010 | Handa | |
| 7,841,321 | B2 | 11/2010 | Kosugi et al. | |
| 7,909,919 | B2 | 3/2011 | Kosugi et al. | |
| 8,105,426 | B2 | 1/2012 | Kosugi et al. | |
| 8,617,299 | B2 | 12/2013 | Hasegawa et al. | |
| 2004/0231829 | A1 | 11/2004 | Amano et al. | |
| 2008/0184973 | A1 * | 8/2008 | Yamazaki | B01D 53/0415 123/519 |
| 2011/0203947 | A1 | 8/2011 | Ogawa | |
| 2011/0214572 | A1 * | 9/2011 | Hasegawa | B01D 53/02 96/122 |
| 2012/0211087 | A1 * | 8/2012 | Dudar | F02D 41/0032 137/12 |
| 2013/0206115 | A1 | 8/2013 | Kragh | |

OTHER PUBLICATIONS

Anonymous, "Method of Controlling Canister Temperature Using Piezo-Electric Material to Improve Emissions in HEV," IPCOM No. 000234770, Published Feb. 3, 2014, 2 pages.

Anonymous, "Electric Grid Utilization for Controlling Canister Temperature to Improve Purge Efficiency in PHEV's," IPCOM No. 000234775, Published Feb. 4, 2014, 2 pages.

Byer, T.G., "Analysis of 2010 Asian Toyota Prius Canister," MeadWestvaco Corporation, Covington, Va, Jul. 28, 2009 6 pages.

Yang, Dennis Seung-Man et al., "System and Methods for Managing Fuel Tank Temperature," U.S. Appl. No. 14/290,725, filed May 29, 2014, 46 pages.

* cited by examiner

SYSTEM AND METHODS FOR MANAGING FUEL VAPOR CANISTER TEMPERATURE

BACKGROUND AND SUMMARY

Vehicle emission control systems may be configured to store fuel vapors from fuel tank refueling and diurnal engine operations in a fuel vapor canister, and then purge the stored vapors during a subsequent engine operation. The stored vapors may be routed to engine intake for combustion, further improving fuel economy.

However, engine run time in hybrid vehicles (HEVs) may be limited, thus limiting engine manifold vacuum, which is typically used to draw fresh air through the fuel vapor canister to desorb the stored fuel vapors. Thus, opportunities for purging fuel vapor from the canister may also be limited. Even if purge conditions are met, the conditions may only be held for a short period of time, leading to incomplete purge cycles. This may result in residual fuel vapors stored in the canister for long periods of time. Over the course of a diurnal cycle, the fuel vapors may desorb from the canister and result in increased bleed emissions.

The desorption of fuel vapors from adsorption material is an endothermic reaction. The desorption efficiency may be increased by heating the fuel vapor canister and/or the purge air. However, dedicated canister heaters add manufacturing costs, and provide an additional load on the vehicle battery. Further the adsorption of fuel vapor to adsorption material is an exothermic reaction. Increasing the efficiency of this reaction would require an additional canister cooling element. Heating the canister without subsequent cooling may limit fuel vapor adsorption in situations where a purge event is followed immediately by the venting of the fuel tank.

The inventors herein have recognized the above problems, and have developed systems and methods to at least partially address them. In one example, a system for an engine, comprising: a fuel vapor canister coupled to a fuel tank; a thermal jacket comprising a phase-change material, the thermal jacket spatially sheathing the fuel vapor canister; and an engine coolant passage positioned to transfer thermal energy between engine coolant and the phase-change material. In this way, the phase-change material may buffer the temperature of the fuel vapor canister by absorbing heat generated during hydrocarbon adsorption, and returning the heat to the vapor canister during hydrocarbon desorption. By coupling the phase-change material to engine coolant, the thermal capacity of the thermal jacket can be increased, as heated coolant can thus transfer thermal energy to the phase-change material to replace the thermal energy transferred to the canister during hydrocarbon desorption.

In another example, a method for a vehicle, comprising: circulating engine coolant through a thermal jacket comprising a phase-change material, the thermal jacket sheathing a fuel vapor canister; and then purging the fuel vapor canister to an engine intake. In this way, the fuel vapor canister may be heated prior to the purge operation, increasing the efficiency of the purge operation, thus decreasing the quantity of residual fuel vapor in the fuel vapor canister. In this way, bleed emissions may be reduced.

In yet another example, a system for a vehicle, comprising: a fuel tank coupled to a fuel vapor canister; an engine intake coupled to the fuel vapor canister via a canister purge valve; a vent line coupled between the fuel vapor canister and atmosphere via a canister vent valve; a thermal jacket configured to spatially sheath the fuel vapor canister, the thermal jacket comprising: a phase change material; an engine coolant inlet; an engine coolant outlet; and channels routed within the thermal jacket coupling the engine coolant inlet and the engine coolant outlet; and a controller configured with instructions stored in non-transitory memory, that when executed, cause the controller to: circulate engine coolant through the thermal jacket; and open the canister purge valve and the canister vent valve responsive to a temperature of the fuel vapor canister increasing above a temperature threshold. In this way, thermal energy from the engine coolant may be transferred to the phase change material, which in turn may transfer the thermal energy to the fuel vapor canister. This eliminates the need for an additional vapor canister heating element, thereby decreasing manufacturing costs and conserving energy within the engine system.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTIONS OF THE DRAWINGS

FIG. 1 schematically shows a cooling system for a vehicle.

FIG. 2 schematically shows a fuel system and emissions system for a vehicle engine.

FIG. 3 schematically shows a system for managing the temperature of a fuel vapor canister.

DETAILED DESCRIPTION

This detailed description relates to systems and methods for managing evaporative emissions in a motor vehicle. In particular, this description relates to improving purge efficiency by managing the temperature of a fuel vapor canister during a purge operation. A vehicle may be configured with a cooling system, such as the example cooling system depicted in FIG. 1. The cooling system may operate to manage the temperature of a vehicle engine, such as the vehicle engine shown in FIG. 2. The vehicle engine may be coupled to a fuel system. To manage fuel vapors generated in the fuel system, a fuel tank may be coupled to a fuel vapor canister, which may be configured to store hydrocarbons. The stored hydrocarbons may be purged out of the fuel vapor canister to the intake of the engine using fresh air drawn from atmosphere. The desorption of fuel vapors is an endothermic reaction, and thus more efficient when the fuel vapor canister and/or the purge air is heated during the purge reaction. The fuel vapor canister and associated air inlet may be sheathed in a thermal jacket containing a phase change material, as shown in FIG. 3. To increase the thermal capacity of the thermal jacket, a cooling line may couple the thermal jacket to the engine cooling system. In this way, the thermal jacket may be heated prior to the purge operation, for example, using the method depicted in FIG. 4. An example timeline for such a purge operation is shown in FIG. 5.

Figure 1:
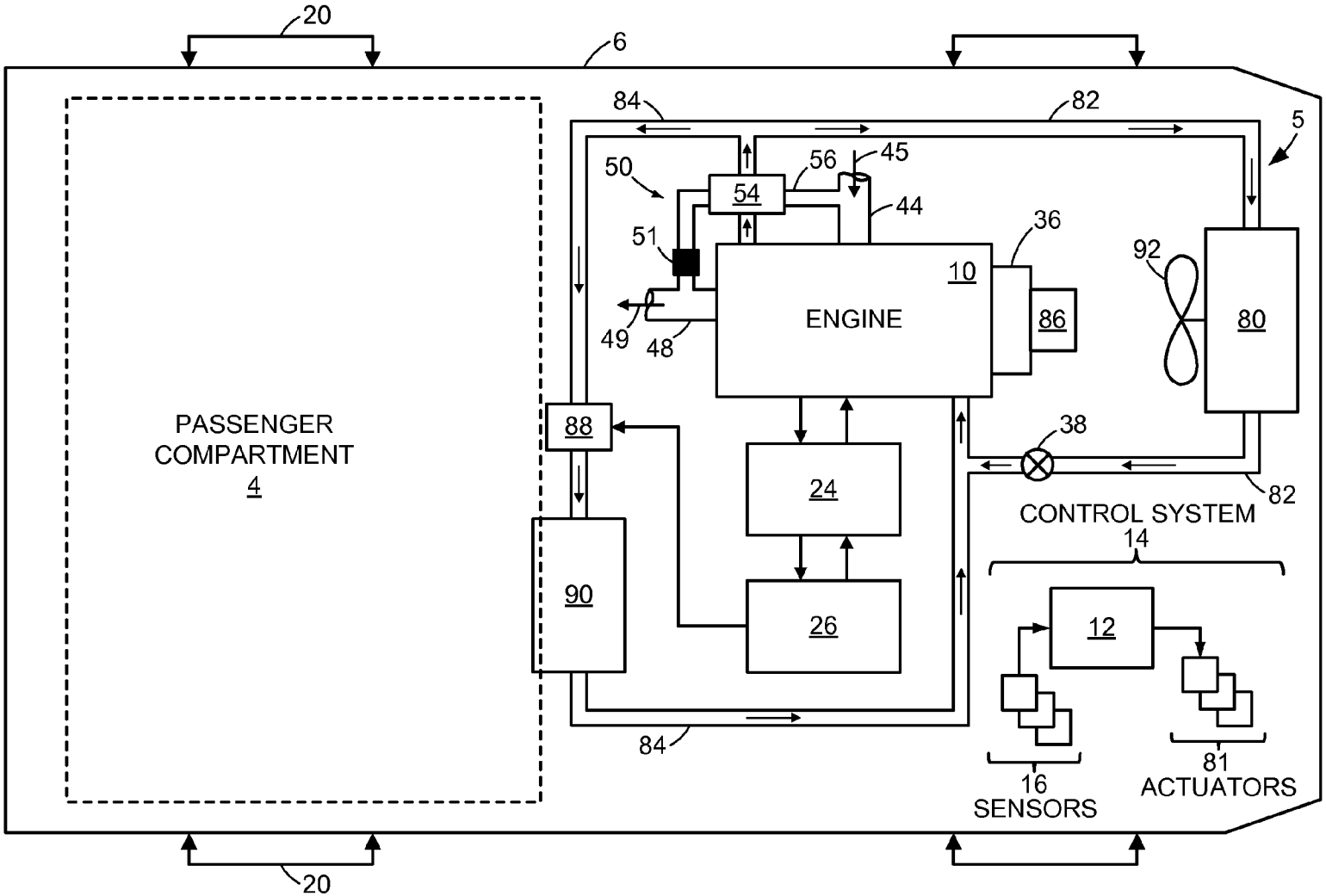

FIG. 1 shows an example embodiment of a cooling system 5 in a motor vehicle 6 is illustrated schematically. Cooling system 5 circulates coolant through internal combustion engine 10 and exhaust gas recirculation (EGR) cooler 54 to absorb waste heat and distributes the heated coolant to radiator 80 and/or heater core 90 via coolant lines 82 and 84, respectively.

In particular, FIG. 1 shows cooling system 100 coupled to engine 10 and circulating engine coolant from engine 10, through EGR cooler 54, and to radiator 80 via engine-driven water pump 86, and back to engine 10 via coolant line 82. Engine-driven water pump 86 may be coupled to the engine via front end accessory drive (FEAD) 36, and rotated proportionally to engine speed via belt, chain, etc. Specifically, engine-driven pump 86 circulates coolant through passages in the engine block, head, etc., to absorb engine heat, which is then transferred via the radiator 80 to ambient air. In an example where pump 86 is a centrifugal pump, the pressure (and resulting flow) produced may be proportional to the crankshaft speed, which may be directly proportional to engine speed. The temperature of the coolant may be regulated by a thermostat valve 38, located in the cooling line 82, which may be kept closed until the coolant reaches a threshold temperature.

Further, fan 92 may be coupled to radiator 80 in order to maintain an airflow through radiator 80 when vehicle 6 is moving slowly or stopped while the engine is running. In some examples, fan speed may be controlled by controller 12. Alternatively, fan 92 may be coupled to engine-driven water pump 86.

As shown in FIG. 1, engine 10 may include an exhaust gas recirculation (EGR) system 50. EGR system 50 may route a desired portion of exhaust gas from exhaust manifold 48 to intake manifold 44 via EGR passage 56. The amount of EGR provided to intake manifold 44 may be varied by controller 12 via EGR valve 51. Further, an EGR sensor (not shown) may be arranged within EGR passage 56 and may provide an indication of one or more of pressure, temperature, and concentration of the exhaust gas. Alternatively, the EGR may be controlled based on an exhaust oxygen sensor and/or and intake oxygen sensor. Under some conditions, EGR system 50 may be used to regulate the temperature of the air and fuel mixture within the combustion chamber. EGR system 50 may further include EGR cooler 54 for cooling exhaust gas 49 being reintroduced to engine 10. In such an embodiment, coolant leaving engine 10 may be circulated through EGR cooler 54 before moving through coolant line 82 to radiator 80.

After passing through EGR cooler 54, coolant may flow through coolant line 82, as described above, and/or through coolant line 84 to heater core 90 where the heat may be transferred to passenger compartment 4, and the coolant flows back to engine 10. In some examples, engine-driven pump 86 may operate to circulate the coolant through both coolant lines 82 and 84. In other examples, such as the example of FIG. 2 in which vehicle 102 has a hybrid-electric propulsion system, an electric auxiliary pump 88 may be included in the cooling system in addition to the engine-driven pump. As such, auxiliary pump 88 may be employed to circulate coolant through heater core 90 during occasions when engine 10 is off (e.g., electric only operation) and/or to assist engine-driven pump 86 when the engine is running, as will be described in further detail below. Like engine-driven pump 86, auxiliary pump 88 may be a centrifugal pump; however, the pressure (and resulting flow) produced by pump 88 may be proportional to an amount of power supplied to the pump by energy storage device 26.

In this example embodiment, the hybrid propulsion system includes an energy conversion device 24, which may include a motor, a generator, among others and combinations thereof. The energy conversion device 24 is further shown coupled to an energy storage device 26, which may include a battery, a capacitor, a flywheel, a pressure vessel, etc. The energy conversion device may be operated to absorb energy from vehicle motion and/or the engine and convert the absorbed energy to an energy form suitable for storage by the energy storage device (e.g., provide a generator operation). The energy conversion device may also be operated to supply an output (power, work, torque, speed, etc.) to the drive wheels 20, engine 10 (e.g., provide a motor operation), auxiliary pump 88, etc. It should be appreciated that the energy conversion device may, in some embodiments, include only a motor, only a generator, or both a motor and generator, among various other components used for providing the appropriate conversion of energy between the energy storage device and the vehicle drive wheels and/or engine.

Hybrid-electric propulsion embodiments may include full hybrid systems, in which the vehicle can run on just the engine, just the energy conversion device (e.g., motor), or a combination of both. Assist or mild hybrid configurations may also be employed, in which the engine is the primary torque source, with the hybrid propulsion system acting to selectively deliver added torque, for example during tip-in or other conditions. Further still, starter/generator and/or smart alternator systems may also be used. Additionally, the various components described above may be controlled by vehicle controller 12 (described below).

From the above, it should be understood that the exemplary hybrid-electric propulsion system is capable of various modes of operation. In a full hybrid implementation, for example, the propulsion system may operate using energy conversion device 24 (e.g., an electric motor) as the only torque source propelling the vehicle. This "electric only" mode of operation may be employed during braking, low speeds, while stopped at traffic lights, etc. In another mode, engine 10 is turned on, and acts as the only torque source powering drive wheel 20. In still another mode, which may be referred to as an "assist" mode, the hybrid propulsion system may supplement and act in cooperation with the torque provided by engine 10. As indicated above, energy conversion device 24 may also operate in a generator mode, in which torque is absorbed from engine 10 and/or the transmission. Furthermore, energy conversion device 24 may act to augment or absorb torque during transitions of engine 10 between different combustion modes (e.g., during transitions between a spark ignition mode and a compression ignition mode).

Figure 2:
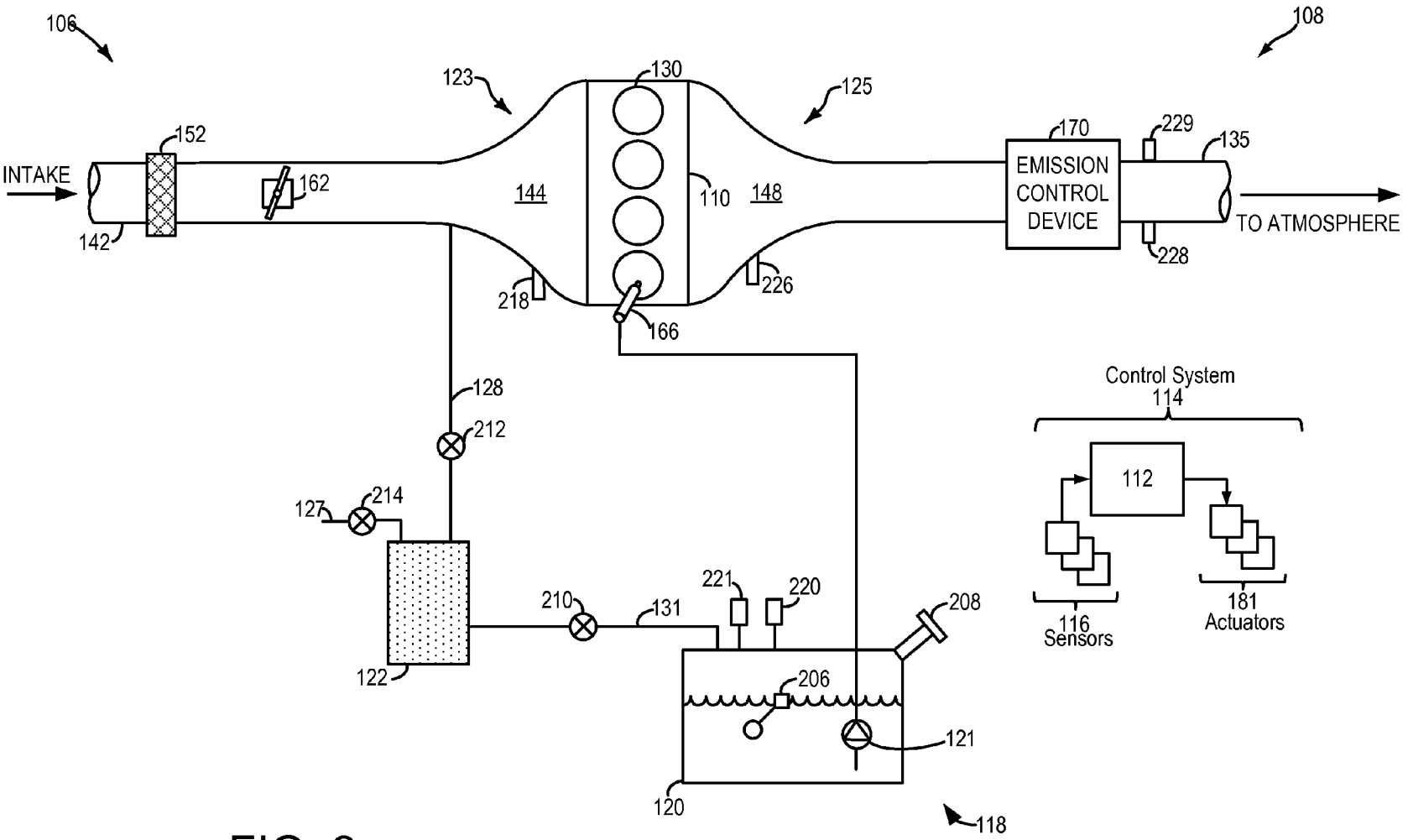
Figure 3:
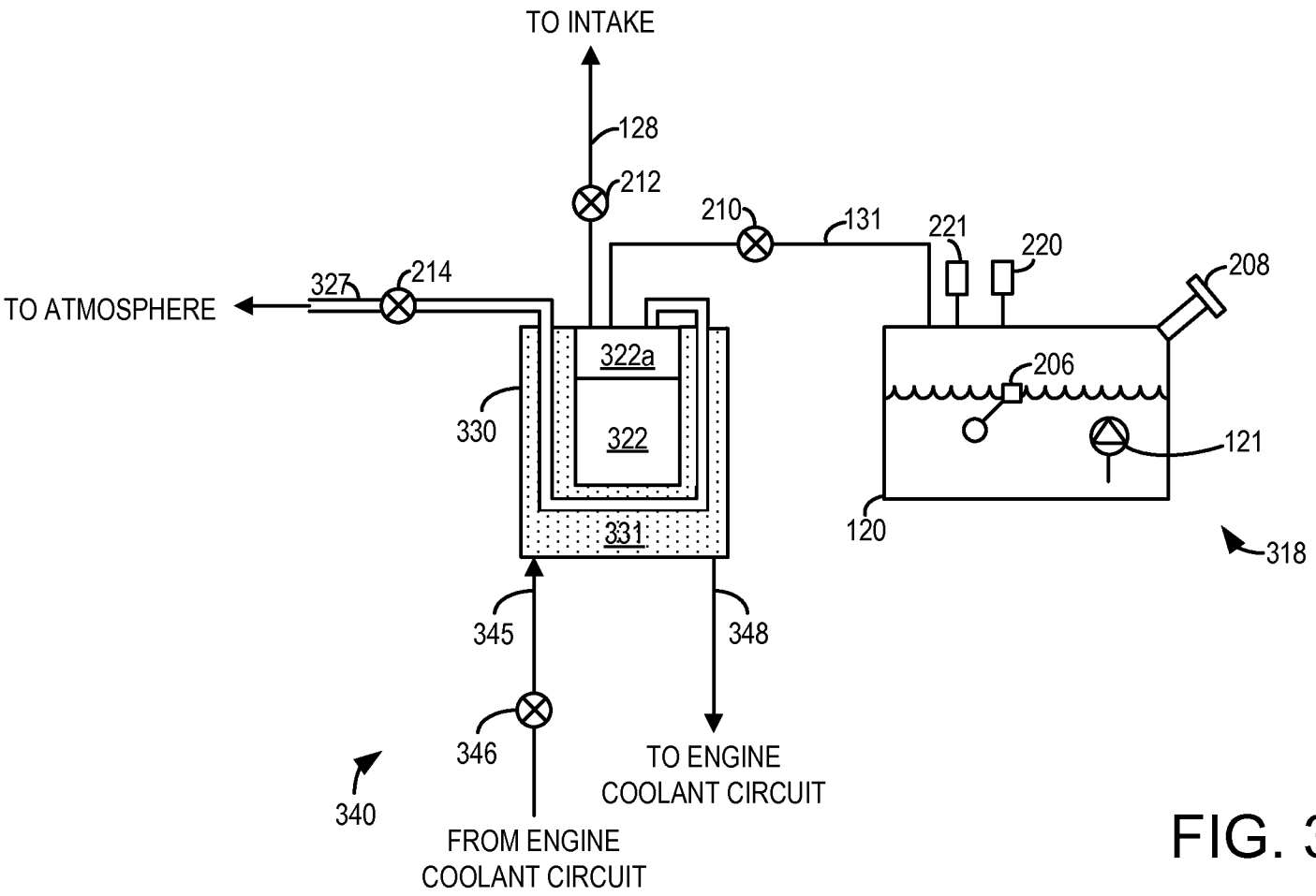

FIG. 2 shows a schematic depiction of a hybrid vehicle system 106 that can derive propulsion power from engine system 108 and/or an on-board energy storage device, such as a battery system. An energy conversion device, such as the energy conversion device shown in FIG. 1, may be operated to absorb energy from vehicle motion and/or engine operation, and then convert the absorbed energy to an energy form suitable for storage by the energy storage device.

Engine system 108 may include an engine 110 having a plurality of cylinders 130. Engine 110 includes an engine intake 123 and an engine exhaust 125. Engine intake 123 includes an air intake throttle 162 fluidly coupled to the engine intake manifold 144 via an intake passage 142. Air may enter intake passage 142 via air filter 152. Engine exhaust 125 includes an exhaust manifold 148 leading to an exhaust passage 135 that routes exhaust gas to the atmosphere. Engine exhaust 125 may include one or more emission control devices 170 mounted in a close-coupled position. The one or more emission control devices may include a three-way catalyst, lean NOx trap, diesel particulate filter, oxidation catalyst, etc. It will be appreciated that other components may be included in the engine such as a variety of valves and sensors, as further elaborated in herein. In some embodiments, wherein engine system 8 is a boosted engine system, the engine system may further include a boosting device, such as a turbocharger (not shown).

Engine system 108 is coupled to a fuel system 118. Fuel system 118 includes a fuel tank 120 coupled to a fuel pump 121 and a fuel vapor canister 122. During a fuel tank refueling event, fuel may be pumped into the vehicle from an external source through refueling port 208. Fuel tank 120 may hold a plurality of fuel blends, including fuel with a range of alcohol concentrations, such as various gasoline-ethanol blends, including E10, E85, gasoline, etc., and combinations thereof. A fuel level sensor 206 located in fuel tank 120 may provide an indication of the fuel level ("Fuel Level Input") to controller 112. As depicted, fuel level sensor 206 may comprise a float connected to a variable resistor. Alternatively, other types of fuel level sensors may be used.

Fuel pump 121 is configured to pressurize fuel delivered to the injectors of engine 110, such as example injector 166. While only a single injector 166 is shown, additional injectors are provided for each cylinder. It will be appreciated that fuel system 118 may be a return-less fuel system, a return fuel system, or various other types of fuel system. Vapors generated in fuel tank 120 may be routed to fuel vapor canister 122, via conduit 131, before being purged to the engine intake 123.

Fuel vapor canister 122 is filled with an appropriate adsorbent for temporarily trapping fuel vapors (including vaporized hydrocarbons) generated during fuel tank refueling operations, as well as diurnal vapors. In one example, the adsorbent used is activated charcoal. When purging conditions are met, such as when the canister is saturated, vapors stored in fuel vapor canister 122 may be purged to engine intake 123 by opening canister purge valve 212. While a single canister 122 is shown, it will be appreciated that fuel system 118 may include any number of canisters. In one example, canister purge valve 212 may be a solenoid valve wherein opening or closing of the valve is performed via actuation of a canister purge solenoid.

Canister 122 includes a vent 127 for routing gases out of the canister 122 to the atmosphere when storing, or trapping, fuel vapors from fuel tank 120. Vent 127 may also allow fresh air to be drawn into fuel vapor canister 122 when purging stored fuel vapors to engine intake 123 via purge line 128 and purge valve 212. While this example shows vent 127 communicating with fresh, unheated air, various modifications may also be used. Vent 127 may include a canister vent valve 214 to adjust a flow of air and vapors between canister 122 and the atmosphere. The canister vent valve may also be used for diagnostic routines. When included, the vent valve may be opened during fuel vapor storing operations (for example, during fuel tank refueling and while the engine is not running) so that air, stripped of fuel vapor after having passed through the canister, can be pushed out to the atmosphere. Likewise, during purging operations (for example, during canister regeneration and while the engine is running), the vent valve may be opened to allow a flow of fresh air to strip the fuel vapors stored in the canister. In one example, canister vent valve 214 may be a solenoid valve wherein opening or closing of the valve is performed via actuation of a canister vent solenoid. In particular, the canister vent valve may be an open that is closed upon actuation of the canister vent solenoid.

As such, hybrid vehicle system 106 may have reduced engine operation times due to the vehicle being powered by engine system 108 during some conditions, and by the energy storage device under other conditions. While the reduced engine operation times reduce overall carbon emissions from the vehicle, they may also lead to insufficient purging of fuel vapors from the vehicle's emission control system. To address this, a fuel tank isolation valve 210 may be optionally included in conduit 131 such that fuel tank 120 is coupled to canister 122 via the valve. During regular engine operation, isolation valve 210 may be kept closed to limit the amount of diurnal or "running loss" vapors directed to canister 122 from fuel tank 120. During refueling operations, and selected purging conditions, isolation valve 210 may be temporarily opened, e.g., for a duration, to direct fuel vapors from the fuel tank 120 to canister 122. By opening the valve during purging conditions when the fuel tank pressure is higher than a threshold (e.g., above a mechanical pressure limit of the fuel tank above which the fuel tank and other fuel system components may incur mechanical damage), the refueling vapors may be released into the canister and the fuel tank pressure may be maintained below pressure limits. While the depicted example shows isolation valve 210 positioned along conduit 131, in alternate embodiments, the isolation valve may be mounted on fuel tank 120.

One or more pressure sensors 220 may be coupled to fuel system 118 for providing an estimate of a fuel system pressure. In one example, the fuel system pressure is a fuel tank pressure, wherein pressure sensor 220 is a fuel tank pressure sensor coupled to fuel tank 120 for estimating a fuel tank pressure or vacuum level. While the depicted example shows pressure sensor 220 directly coupled to fuel tank 120, in alternate embodiments, the pressure sensor may be coupled between the fuel tank and canister 122, specifically between the fuel tank and isolation valve 210. In still other embodiments, a first pressure sensor may be positioned upstream of the isolation valve (between the isolation valve and the canister) while a second pressure sensor is positioned downstream of the isolation valve (between the isolation valve and the fuel tank), to provide an estimate of a pressure difference across the valve. In some examples, a vehicle control system may infer and indicate a fuel system leak based on changes in a fuel tank pressure during a leak diagnostic routine.

One or more temperature sensors 221 may also be coupled to fuel system 118 for providing an estimate of a fuel system temperature. In one example, the fuel system temperature is a fuel tank temperature, wherein temperature sensor 221 is a fuel tank temperature sensor coupled to fuel tank 120 for estimating a fuel tank temperature. While the depicted example shows temperature sensor 221 directly coupled to fuel tank 120, in alternate embodiments, the temperature sensor may be coupled between the fuel tank and canister 122.

Fuel vapors released from canister 122, for example during a purging operation, may be directed into engine intake manifold 144 via purge line 128. The flow of vapors along purge line 128 may be regulated by canister purge valve 212, coupled between the fuel vapor canister and the engine intake. The quantity and rate of vapors released by the canister purge valve may be determined by the duty cycle of an associated canister purge valve solenoid (not shown). As such, the duty cycle of the canister purge valve solenoid may be determined by the vehicle's powertrain control module (PCM), such as controller 112, responsive to engine operating conditions, including, for example, engine speed-load conditions, an air-fuel ratio, a canister load, etc. By commanding the canister purge valve to be closed, the controller may seal the fuel vapor recovery system from the engine intake. An optional canister check valve (not shown) may be included in purge line 128 to prevent intake manifold pressure from flowing gases in the opposite direction of the purge flow. As such, the check valve may be necessary if the canister purge valve control is not accurately timed or the canister purge valve itself can be forced open by a high intake manifold pressure. An estimate of the manifold absolute pressure (MAP) or manifold vacuum (ManVac) may be obtained from MAP sensor 218 coupled to intake manifold 144, and communicated with controller 112. Alternatively, MAP may be inferred from alternate engine operating conditions, such as mass air flow (MAF), as measured by a MAF sensor (not shown) coupled to the intake manifold.

Fuel system 118 may be operated by controller 112 in a plurality of modes by selective adjustment of the various valves and solenoids. For example, the fuel system may be operated in a fuel vapor storage mode (e.g., during a fuel tank refueling operation and with the engine not running), wherein the controller 112 may open isolation valve 210 and canister vent valve 214 while closing canister purge valve (CPV) 212 to direct refueling vapors into canister 122 while preventing fuel vapors from being directed into the intake manifold.

As another example, the fuel system may be operated in a refueling mode (e.g., when fuel tank refueling is requested by a vehicle operator), wherein the controller 112 may open isolation valve 210 and canister vent valve 214, while maintaining canister purge valve 212 closed, to depressurize the fuel tank before allowing enabling fuel to be added therein. As such, isolation valve 210 may be kept open during the refueling operation to allow refueling vapors to be stored in the canister. After refueling is completed, the isolation valve may be closed.

As yet another example, the fuel system may be operated in a canister purging mode (e.g., after an emission control device light-off temperature has been attained and with the engine running), wherein the controller 112 may open canister purge valve 212 and canister vent valve while closing isolation valve 210. Herein, the vacuum generated by the intake manifold of the operating engine may be used to draw fresh air through vent 127 and through fuel vapor canister 122 to purge the stored fuel vapors into intake manifold 144. In this mode, the purged fuel vapors from the canister are combusted in the engine. The purging may be continued until the stored fuel vapor amount in the canister is below a threshold. During purging, the learned vapor amount/concentration can be used to determine the amount of fuel vapors stored in the canister, and then during a later portion of the purging operation (when the canister is sufficiently purged or empty), the learned vapor amount/concentration can be used to estimate a loading state of the fuel vapor canister. For example, one or more oxygen sensors (not shown) may be coupled to the canister 122 (e.g., downstream of the canister), or positioned in the engine intake and/or engine exhaust, to provide an estimate of a canister load (that is, an amount of fuel vapors stored in the canister). Based on the canister load, and further based on engine operating conditions, such as engine speed-load conditions, a purge flow rate may be determined.

Vehicle system 106 may further include control system 114. Control system 114 is shown receiving information from a plurality of sensors 116 (various examples of which are described herein) and sending control signals to a plurality of actuators 181 (various examples of which are described herein). As one example, sensors 116 may include exhaust gas sensor 226 located upstream of the emission control device, temperature sensor 228, MAP sensor 218, pressure sensor 220, and pressure sensor 229. Other sensors such as additional pressure, temperature, air/fuel ratio, and composition sensors may be coupled to various locations in the vehicle system 106. As another example, the actuators may include fuel injector 166, isolation valve 210, purge valve 212, vent valve 214, fuel pump 121, and throttle 162.

Control system 114 may further receive information regarding the location of the vehicle from an on-board global positioning system (GPS). Information received from the GPS may include vehicle speed, vehicle altitude, vehicle position, etc. This information may be used to infer engine operating parameters, such as local barometric pressure. Control system 114 may further be configured to receive information via the internet or other communication networks. Information received from the GPS may be cross-referenced to information available via the internet to determine local weather conditions, local vehicle regulations, etc. Control system 114 may use the internet to obtain updated software modules which may be stored in non-transitory memory.

The control system 114 may include a controller 112. Controller 112 may be configured as a conventional microcomputer including a microprocessor unit, input/output ports, read-only memory, random access memory, keep alive memory, a controller area network (CAN) bus, etc. Controller 112 may be configured as a powertrain control module (PCM). The controller may be shifted between sleep and wake-up modes for additional energy efficiency. The controller may receive input data from the various sensors, process the input data, and trigger the actuators in response to the processed input data based on instruction or code programmed therein corresponding to one or more routines. An example control routine is described herein with regard to FIG. 4.

The process of adsorbing fuel vapor to a carbon bed is an exothermic reaction. Removing heat generated during the adsorption process may thus increase the adsorption efficiency of the fuel vapor canister, increasing the effective capacity of the canister. Conversely, the desorption process is an endothermic reaction. By heating the fuel vapor canister and/or the atmospheric air used to purge the canister contents to intake, the desorption efficiency may be increased, thereby allowing more fuel vapor to be stored during a subsequent fuel tank venting operation, and decreasing the possibility of bleed emissions.

FIG. 3 schematically shows an example system for managing the temperature of a fuel vapor canister. The system may be incorporated into the example vehicle systems depicted in FIGS. 1 and 2. As such, components that are conserved between these systems are numbered accordingly, and may not be reintroduced. However, it should be understood that the system may also be applied to other engine or vehicle systems without departing form the scope of this disclosure.

FIG. 3 shows an example fuel system 318. Fuel tank 120 may be coupled to fuel vapor canister 322. Canister 322 may include a buffer 322*a* (or buffer region), each of the canister and the buffer comprising the adsorbent. As shown, the volume of buffer 322*a* may be smaller than (e.g., a fraction of) the volume of canister 322. The adsorbent in the buffer 322*a* may be same as, or different from, the adsorbent in the canister (e.g., both may include charcoal). Buffer 322*a* may be positioned within canister 322 such that during canister loading, fuel tank vapors are first adsorbed within the buffer, and then when the buffer is saturated, further fuel tank vapors are adsorbed in the canister. In comparison, during canister purging, fuel vapors are first desorbed from the canister (e.g., to a threshold amount) before being desorbed from the buffer. In other words, loading and unloading of the buffer is not linear with the loading and unloading of the canister. As such, the effect of the canister buffer is to dampen any fuel vapor spikes flowing from the fuel tank to the canister, thereby reducing the possibility of any fuel vapor spikes going to the engine.

Canister 322 may receive fuel vapor from fuel tank 120 via conduit 131 upon the opening of FTIV 210. Fuel vapor may be purged from canister 322 to the intake of the vehicle engine via purge line 128 when CPV 212 is opened, and when CVV 214 is opened, drawing atmospheric air through vent line 327. Further, if CVV 214 is opened while fuel vapor is being vented from fuel tank 120 to canister 322, air stripped of fuel vapor may be vented to atmosphere.

Canister 322 may be sheathed by thermal jacket 330. Thermal jacket 330 may comprise a phase change material (PCM) 331. A phase change material may be defined as a chemical formulation that undergoes a phase transition from a first phase to a second phase at a phase transition temperature (PTT) inherent to the material. Typically, this phase transition is between a solid phase and a liquid phase. The PCM absorbs a quantity of heat (known as a fusion energy) while in the first phase. By placing the PCM in a heat transfer relationship with an object, the PCM may absorb heat as the object increases in temperature, thus maintaining the temperature of the object.

Many different PCMs are known in the art, such as paraffin, polyethylene glycols, lithium nitrate trihydrate, and various organic and inorganic compounds. The chemical composition of the PCM determines the PTT and fusion energy of the PCM. As such, an appropriate PCM may be chosen to fill thermal jacket 330 based on the size of the fuel vapor canister and the composition of the adsorbent material stored within the canister. In other words, the composition and quantity of PCM 331 within thermal jacket 330 may be selected to match the expected amount of heat generated by the fuel vapor canister upon adsorption. PCM 331 may be stored in bulk within thermal jacket 330, may be embedded in granules, or may be embedded within a wall of fuel vapor canister 322. The PCM may be distributed evenly throughout thermal jacket 330, or may be distributed based on the adsorption/desorption profile of the canister (e.g. more PCM may be in a placed in a heat transfer relationship with areas of the canister that adsorb more fuel vapor). Thus, during a fuel tank venting operation, as the temperature of canister 322 increases upon adsorption, the generated heat may be transferred to the PCM, thereby mitigating the temperature increase of the canister, and increasing adsorption efficiency. Conversely, heat adsorbed by the PCM may be transferred back to canister 322 during a canister purge operation. As the fuel vapor desorbs from the adsorption material, heat may be transferred from the PCM to the canister, mitigating the temperature decrease occurring during the endothermic desorption process.

Thermal jacket 330 may also sheath a portion of vent line 327. As shown in FIG. 3, thermal jacket 330 may be routed to encompass a passage for vent line 327, but in other configuration, thermal jacket 330 may extend from the fuel vapor canister to cover a portion of vent line 327. In this way, atmospheric purge air may be heated by PCM 331 via heat transfer prior to reaching fuel vapor canister 322. The heated purge air may allow for a further increase in desorption efficiency.

A cooling circuit 340 may be coupled to thermal jacket 330 in order to increase the thermal capacity of the jacket. Cooling circuit 340 may comprise a coolant inlet 345. Flow of coolant into coolant circuit 340 may be mediated by coolant valve 346. Coolant valve 346 may be controlled via commands from the vehicle controller 112. In some examples, coolant valve 346 may be a thermostatic valve. In examples where thermal jacket 330 is used to heat canister 322 and/or purge air entering the canister, coolant circuit 340 may be coupled to an engine cooling circuit at a point in the engine cooling circuit where the coolant is heated. For example, in the cooling system shown in FIG. 1, coolant circuit 340 may be coupled to coolant line 82 upstream of the radiator, such that heated coolant returning to the radiator is supplied to cooling circuit 340 upon the opening of valve 346. Alternatively, coolant circuit may be coupled to coolant line 84 between the EGR cooler and the heater core, such that coolant heated by EGR is supplied to cooling circuit 340 upon the opening of valve 346. In some examples, coolant circuit 340 may have multiple points of connection to a coolant system. For example, coolant circuit 340 may be configured to draw coolant from either upstream or downstream of the radiator, so that coolant of different temperatures may be flown through the circuit. In this way, low temperature coolant may be circulated through the thermal jacket during fuel tank venting, and high temperature coolant may be circulated through the thermal jacket prior to and during purge operations. Coolant circuit 340 may include one or more auxiliary pumps configured to drive coolant through the circuit.

Figure 4:
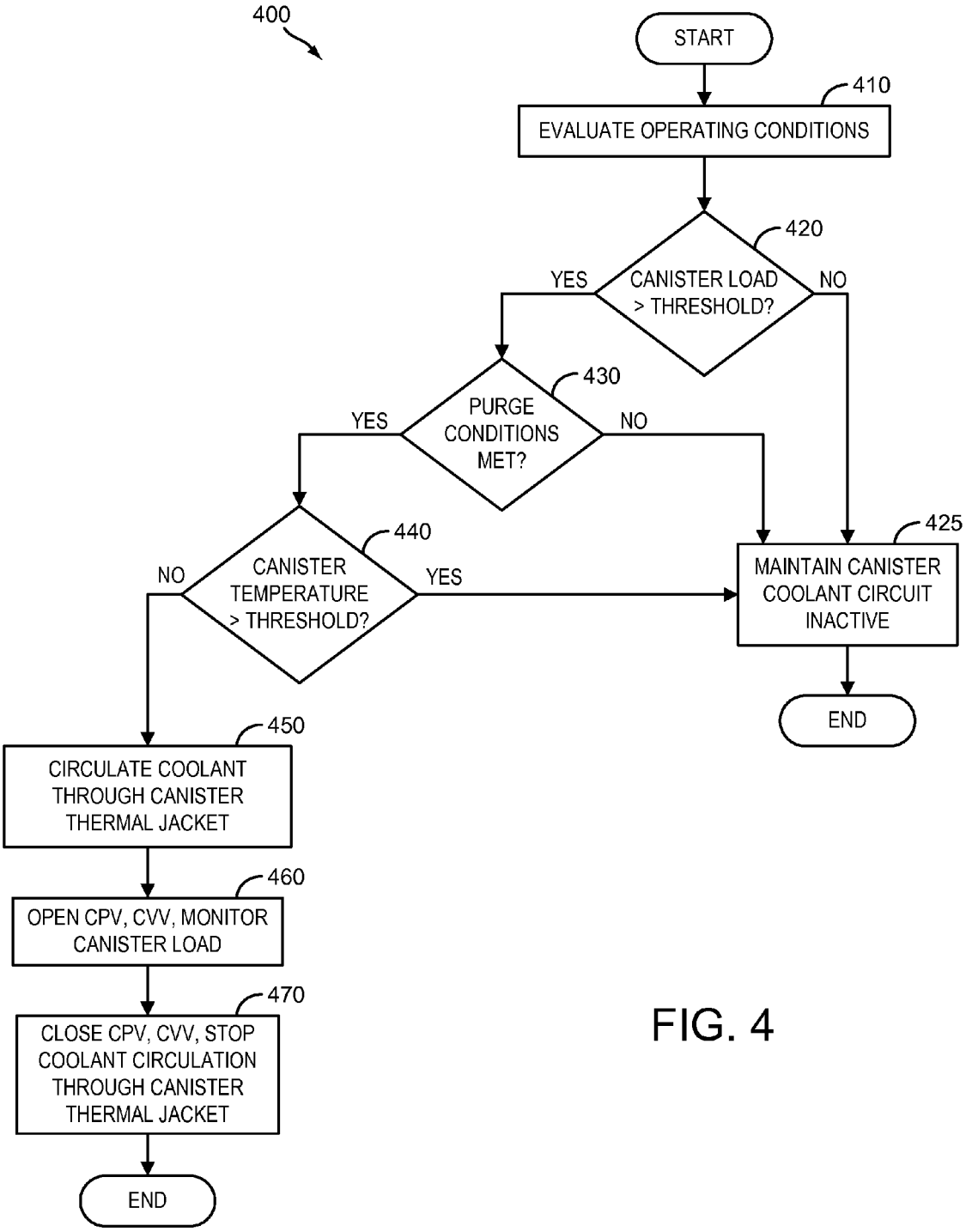
FIG. 4 shows a flow chart for a high level method for purging a fuel vapor canister using the systems depicted in FIGS. 1-3.
Figure 5:
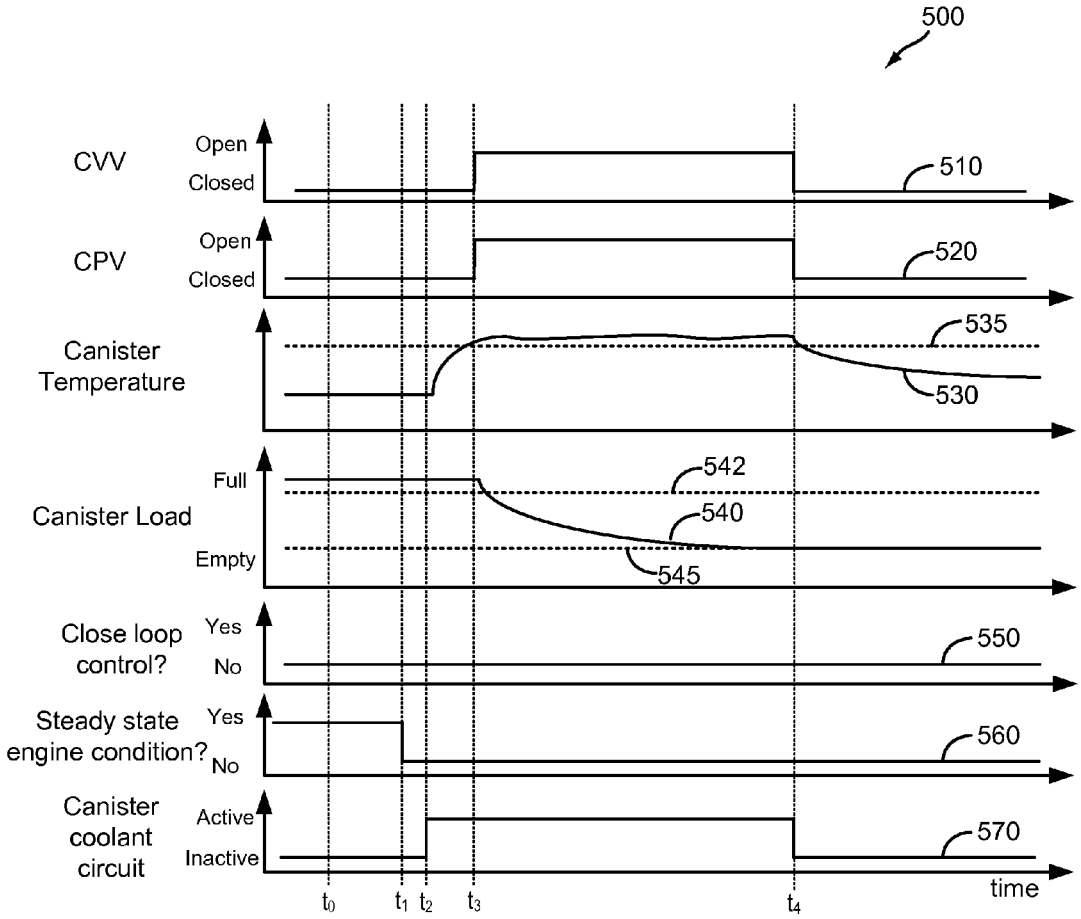
FIG. 5 shows an example timeline for a purge routine using the method shown in FIG. 4

FIG. 4 shows a flow chart for an example high-level method 400 for a canister purge operation in accordance with the present disclosure. Method 400 will be described in reference to the systems described in FIGS. 1-3, though it should be understood that method 400 may be applied to other systems without departing from the scope of this disclosure. Method 400 may be carried out by a controller, such as controller 112, and may be stored as executable instructions in non-transitory memory.

Method 400 may begin at 410. At 410, method 400 may include evaluating operating conditions. Operating conditions may be measured, estimated or inferred, and may include various vehicle conditions, such as vehicle speed and vehicle location, various engine operating conditions, such as engine operating mode, engine speed, engine temperature, exhaust temperature, boost level, MAP, MAF, torque demand, horsepower demand, etc., and various ambient conditions, such as temperature, barometric pressure, humidity, etc.

Continuing at 420, method 400 may include determining whether a fuel vapor canister load is above a threshold. The fuel vapor canister load threshold may be predetermined, or may be based on current conditions. The fuel vapor canister load may be determined by monitoring the quantity of fuel vapor entering the fuel vapor canister following the most recent canister purge event. Fuel vapor entering the fuel vapor canister may be quantified based on fuel tank pressure prior to venting the fuel tank, based on changes on canister temperature during fuel tank venting, based on signals from an oxygen or hydrocarbon sensor coupled within or near the fuel vapor canister, etc. If canister load is determined to be less than the threshold, method 400 may proceed to 425. At 425, method 400 may include maintaining canister coolant circuit 340 inactive. Maintaining the canister coolant circuit inactive may include maintaining valve 346 closed, and may further include maintaining an auxiliary pump coupled to coolant circuit 340 off.

If the canister load is determined to be greater than the threshold, method 400 may proceed to 430. At 430, method 400 may include determining whether purge conditions are met. Determining whether purge conditions are met may include determining engine operating status, commanded A/F ratio, whether close loop purge fuel control is active, whether the engine is in a steady-state condition, etc. If purge conditions are not met, method 400 may proceed to 425, and may include maintaining coolant circuit 340 inactive. Method 400 may then end.

If purge conditions are met, method 400 may proceed to 440. At 440, method 400 may include determining whether the canister temperature is greater than a threshold. The canister temperature threshold may be predetermined, or may be based on current conditions, such as canister load, ambient temperature, and engine manifold vacuum. If the canister temperature is determined to be above the threshold, method 400 may proceed to 425, and may include maintaining coolant circuit 340 inactive. Method 400 may then end.

If the canister temperature is determined to be below the threshold, method 400 may proceed to 450. At 450, method 400 may include circulating coolant through canister coolant circuit 340, thus circulating coolant through canister thermal jacket 330. In this way, heat from the coolant may be transferred to PCM 331 stored in thermal jacket 330, and subsequently transferred from PCM 331 to canister 322. Circulating coolant through the canister thermal jacket may include opening coolant valve 346, and may further include activating one or more auxiliary coolant pumps coupled to cooling circuit 340. Prior to proceeding to 460, coolant may be circulated through thermal jacket 330 for a predetermined amount of time or until the canister temperature increases above a threshold.

Continuing at 460, method 400 may include opening the CPV and CVV, thus initiating a canister purge routine. Atmospheric air drawn through vent line 327 may be heated through heat transfer with thermal jacket 330 prior to facilitating the desorption of fuel vapors from fuel vapor canister 322. Method 400 may also include monitoring the fuel vapor canister load during the purging operation. Prior to proceeding to 470, the purge operation may be maintained for a predetermined amount of time, until the canister load has decreased below a threshold, or until purge conditions are no longer met.

Continuing at 470, method 400 may include closing the CPV and CVV, and stopping circulation of coolant through coolant circuit 340 and thermal jacket 330. Stopping the circulation of coolant through coolant circuit 340 and thermal jacket 330 may include closing valve 346 and may further include deactivating a coolant pump coupled to coolant circuit 340. Method 400 may then end.

FIG. 5 shows an example timeline 500 for a fuel vapor canister purge operation utilizing a canister comprising a thermal jacket coupled to a cooling circuit using the method described herein and with regard to FIG. 4 as applied to the system described herein and with regard to FIGS. 1-3. Timeline 500 includes plot 510 indicating the status of a canister vent valve over time. Timeline 500 further includes plot 520, indicating the status of a canister purge valve over time. Timeline 500 further includes pot 530, indicating a canister temperature over time; plot 540, indicating a canister load over time; plot 550, indicating whether close loop purge control is active over time; plot 560, indicating whether an engine is in a steady state condition over time, and plot 570, indicating whether a canister cooling circuit is active or inactive over time. Line 535 represents a threshold canister temperature for initiating a purge operation. Line 542 represents a threshold canister load for initiating a purge operation. Line 545 represents a threshold canister load for completing a purge operation.

At time $t_0$, the canister load is above the purging threshold represented by line 542, as shown by plot 540. Close loop purge control is not active, as shown by plot 550, however the engine is in a steady-state condition, as shown by plot 560. Thus, conditions are not met for a purge operation. Accordingly, the CVV and CPV remain closed, as shown by plots 510 and 520, respectively, and the canister cooling circuit is maintained inactive, as shown by plot 570.

At time $t_1$, the engine is no longer in a steady-state condition, as shown by plot 560. Thus, purge conditions are met. However, the canister temperature (as shown by plot 530) is below the purge temperature threshold depicted by line 535. Accordingly, the CVV and CPV remain closed, as shown by plots 510 and 520, respectively. At time $t_2$, the canister cooling circuit is activated, drawing heated coolant through the circuit, and transferring heat to the PCM stored within the canister thermal jacket. Accordingly, the canister temperature rises.

At time $t_3$, the canister temperature reaches the canister temperature threshold, as shown by plot 530 and line 535. The purge operation may now begin, and the CVV and CPV are opened, as shown by plots 510 and 520, respectively. Accordingly, the canister load decreases, as shown by plot 540. The canister temperature remains reasonably stable, as shown by plot 530. While the desorption of fuel vapor from the canister is endothermic, the circulation of heated coolant through the canister coolant circuit maintains the temperature of the PCM within the thermal jacket.

At time $t_4$, the canister load reaches the threshold depicted by line 545. The CVV and CPV are closed, and the canister cooling circuit is deactivated. This ends the purging operation.

The canister temperature decreases, as heated coolant is no longer supplied to the coolant circuit. The systems described herein and depicted in FIGS. 1-3 along with the method described herein and depicted in FIG. 4 may enable one or more systems and one or more methods. In one example, a system for an engine, comprising: a fuel vapor canister coupled to a fuel tank; a thermal jacket comprising a phase-change material, the thermal jacket spatially sheathing the fuel vapor canister; and an engine coolant passage positioned to transfer thermal energy between engine coolant and the phase-change material. The thermal jacket may further comprise the engine coolant passage, which may further comprise: an engine coolant inlet; an engine coolant outlet; and channels routed within the thermal jacket coupling the engine coolant inlet and the engine coolant outlet. The engine coolant inlet may be coupled to an engine coolant line upstream of a radiator. In some examples, a coolant valve may be coupled between the engine coolant line and the engine coolant inlet. The coolant valve may be selectively operable to allow flow of engine coolant into the engine coolant inlet. In some examples, the engine system may further comprise: a vent line coupled between an air inlet of the fuel vapor canister and atmosphere; and wherein: the thermal jacket is configured to transfer thermal energy from the phase-change material and atmospheric air entering the vent line. The thermal jacket may further comprise: a channel routed within the thermal jacket coupling the vent line to the air inlet of the fuel vapor canister. The technical result of implementing this system is that the phase-change material may buffer the temperature of the fuel vapor canister by absorbing heat generated during hydrocarbon adsorption, and returning the heat to the vapor canister during hydrocarbon desorption. By coupling the phase-change material to engine coolant, the thermal capacity of the thermal jacket can be increased, as heated coolant can thus transfer thermal energy to the phase-change material to replace the thermal energy transferred to the canister during hydrocarbon desorption. Thus, both the adsorption of fuel vapor to within the canister and the desorption of fuel vapor from the canister may be increased in efficiency.

In another example, a method for a vehicle, comprising: circulating engine coolant through a thermal jacket comprising a phase-change material, the thermal jacket sheathing a fuel vapor canister; and then purging the fuel vapor canister to an engine intake. Purging the fuel vapor canister may include purging contents of the fuel vapor canister to an engine intake, which further comprises: drawing atmospheric air into the fuel vapor canister via a vent line, at least a portion of the vent line sheathed by the thermal jacket. Circulating engine coolant through a thermal jacket may further comprise: directing engine coolant from an engine coolant line into a coolant circuit coupled within the thermal jacket. Directing engine coolant from an engine coolant line into a coolant circuit coupled within the thermal jacket may further comprise: opening a coolant valve coupled within the coolant circuit. The coolant circuit may be coupled to the engine coolant line upstream of a radiator, such that opening the coolant valve directs heated coolant into the coolant circuit. The method may further comprise: responsive to a fuel vapor canister load decreasing below a threshold, ceasing circulating engine coolant through the thermal jacket. In some examples, the method may further comprise: maintaining the coolant valve closed responsive to a fuel vapor canister temperature being greater than a threshold. The technical result of implementing this method is a reduction in bleed emissions. Both the fuel vapor canister and the purge air may be heated prior to the purge operation, increasing the efficiency of the purge operation, thus decreasing the quantity of residual fuel vapor in the fuel vapor canister.

In yet another example, a system for a vehicle, comprising: a fuel tank coupled to a fuel vapor canister; an engine intake coupled to the fuel vapor canister via a canister purge valve; a vent line coupled between the fuel vapor canister and atmosphere via a canister vent valve; a thermal jacket configured to spatially sheath the fuel vapor canister, the thermal jacket comprising: a phase change material; an engine coolant inlet; an engine coolant outlet; and channels routed within the thermal jacket coupling the engine coolant inlet and the engine coolant outlet; and a controller configured with instructions stored in non-transitory memory, that when executed, cause the controller to: circulate engine coolant through the thermal jacket; and open the canister purge valve and the canister vent valve responsive to a temperature of the fuel vapor canister increasing above a temperature threshold. The controller may be further configured with instructions stored in non-transitory memory, that when executed, cause the controller to: responsive to a fuel vapor canister load decreasing below a loading threshold, close the canister purge valve; and cease circulating engine coolant through the thermal jacket. The thermal jacket may further configured to sheath at least part of the vent line. The thermal jacket may be routed to comprise channels for engine coolant and atmospheric air. The system may further comprise an engine coolant line coupled between an engine and a radiator; and the engine coolant inlet may be coupled to the engine coolant line upstream of the radiator. In some examples, the system may further comprise a coolant valve coupled between the engine coolant line and the engine coolant inlet. The technical result of implementing this system is an increase in fuel vapor canister purge efficiency without requiring an additional canister heating element. Rather, heat generated by the engine may be transferred to the canister and purge air via engine coolant and a phase change material embedded in the thermal jacket, thereby decreasing manufacturing costs and conserving energy within the engine system.

Note that the example control and estimation routines included herein can be used with various engine and/or vehicle system configurations. The control methods and routines disclosed herein may be stored as executable instructions in non-transitory memory. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A system for an engine, comprising:

a fuel vapor canister coupled to a fuel tank, the fuel vapor canister having adsorbent material stored therewithin;

a thermal jacket spatially sheathing the fuel vapor canister, the thermal jacket comprising a phase-change material stored therewithin, external to the fuel vapor canister;

an engine coolant passage including channels routed within the thermal jacket, the channels positioned to transfer thermal energy between engine coolant and the phase-change material; and a vent line coupled between an air inlet of the fuel vapor canister and atmosphere, the vent line routed within the thermal jacket, external to the fuel vapor canister, and sheathed by the thermal jacket.

2. The system of claim 1, where the thermal jacket further comprises the engine coolant passage, which further comprises:

an engine coolant inlet; and an engine coolant outlet;

wherein the channels are routed within the thermal jacket, external to the fuel vapor canister, and couple the engine coolant inlet with the engine coolant outlet.

3. The system of claim 2, where the engine coolant inlet is coupled to an engine coolant line upstream of a radiator.

4. The system of claim 3, further comprising:

a coolant valve coupled between the engine coolant line and the engine coolant inlet.

5. The system of claim 4, wherein the coolant valve is selectively operable to allow flow of engine coolant into the engine coolant inlet.

6. The system of claim 1, wherein the thermal jacket is configured to transfer thermal energy between the phase-change material and atmospheric air as it flows through the vent line.

7. The system of claim 1, further comprising:

an engine intake coupled to the fuel vapor canister via a canister purge valve;

a canister vent valve arranged in the vent line; and a controller configured with instructions stored in non-transitory memory that, when executed, cause the controller to:

determine a fuel vapor canister load;

responsive to the fuel vapor canister load being greater than a loading threshold, determine whether purge conditions are met;

responsive to the purge conditions being met, determine a fuel vapor canister temperature;

responsive to the fuel vapor canister temperature being greater than a temperature threshold, circulate the engine coolant through the thermal jacket via the channels, open the canister purge valve, and open the canister vent valve.

8. A method for a vehicle, comprising:

circulating engine coolant through channels routed within a thermal jacket, the thermal jacket sheathing a fuel vapor canister and comprising a phase-change material stored therewithin, external to the fuel vapor canister, and the fuel vapor canister having adsorbent material stored therewithin; and then drawing atmospheric air into a vent line which is routed within the thermal jacket, external to the fuel vapor canister, and sheathed by the thermal jacket, transferring heat from the thermal jacket to the atmospheric air as it flows through the vent line, and then drawing the heated atmospheric air from the vent line into an air inlet of the fuel vapor canister to purge contents of the fuel vapor canister to an engine intake.

9. The method of claim 8, where circulating engine coolant through the channels routed through the thermal jacket further comprises:

directing engine coolant from an engine coolant line into a coolant circuit coupled within the thermal jacket, external to the fuel vapor canister, the coolant circuit comprising the channels.

10. The method of claim 9, where directing engine coolant from the engine coolant line into the coolant circuit coupled within the thermal jacket further comprises:

opening a coolant valve coupled within the coolant circuit.

11. The method of claim 10, where the coolant circuit is coupled to the engine coolant line upstream of a radiator, such that opening the coolant valve directs heated coolant into the coolant circuit.

12. The method of claim 10, further comprising:

maintaining the coolant valve closed responsive to a fuel vapor canister temperature being greater than a threshold.

13. The method of claim 10, further comprising:

maintaining the coolant valve closed during steady-state engine operation.

14. The method of claim 8, further comprising:

responsive to a fuel vapor canister load decreasing below a threshold, ceasing circulating engine coolant through the channels routed within the thermal jacket.

15. A system for a vehicle, comprising:

a fuel tank coupled to a fuel vapor canister, the fuel vapor canister having adsorbent material stored therewithin;

an engine intake coupled to the fuel vapor canister via a canister purge valve;

a thermal jacket configured to spatially sheath the fuel vapor canister, the thermal jacket comprising:

a phase-change material stored therewithin, external to the fuel vapor canister;

an engine coolant inlet;

an engine coolant outlet; and one or more channels routed within the thermal jacket, external to the fuel vapor canister, the one or more channels coupling the engine coolant inlet and the engine coolant outlet;

a vent line coupling an air inlet of the fuel vapor canister with atmosphere via a canister vent valve, the vent line routed within the thermal jacket, external to the fuel vapor canister, and sheathed by the thermal jacket; and a controller configured with instructions stored in non-transitory memory that, when executed, cause the controller to:

circulate engine coolant through the thermal jacket via the one or more channels; and open the canister purge valve and the canister vent valve responsive to a temperature of the fuel vapor canister increasing above a temperature threshold.

16. The system of claim 15, where the controller is further configured with instructions stored in non-transitory memory that, when executed, cause the controller to:

responsive to a fuel vapor canister load decreasing below a loading threshold, close the canister purge valve; and cease circulating engine coolant through the thermal jacket.

17. The system of claim 15, further comprising:

an engine coolant line coupled between an engine and a radiator;

wherein the engine coolant inlet is coupled to the engine coolant line upstream of the radiator.

18. The system of claim 17, further comprising:

a coolant valve coupled between the engine coolant line and the engine coolant inlet.

19. A system for an engine, comprising:

a fuel vapor canister coupled to a fuel tank, the fuel vapor canister having adsorbent material stored therewithin;

a thermal jacket spatially sheathing the fuel vapor canister, the thermal jacket comprising a phase-change material stored therewithin, external to the fuel vapor canister; and an engine coolant passage including channels routed within the thermal jacket, external to the fuel vapor canister, the channels positioned to transfer thermal energy between engine coolant and the phase-change material.

20. The system of claim 19, further comprising:

a controller configured with instructions stored in non-transitory memory that, when executed, cause the controller to:

determine a temperature of the fuel vapor canister; and responsive to the temperature of the fuel vapor canister increasing above a temperature threshold, circulate the engine coolant through the thermal jacket via the channels, open a canister purge valve, and open a canister vent valve.

* * * * *